United States Patent [19]

Sugita et al.

[11] Patent Number: 4,867,658

[45] Date of Patent: Sep. 19, 1989

[54] ROTARY VANE COMPRESSOR HAVING PRESSURE-BIASED VANES

[75] Inventors: Terumitsu Sugita; Koji Urushibara, both of Narashino, Japan

[73] Assignee: Seiko Seiki Kabushiki Kaisha, Japan

[21] Appl. No.: 447,528

[22] Filed: Dec. 7, 1982

[30] Foreign Application Priority Data

Dec. 8, 1981 [JP] Japan ..... 56-182714[U]

[51] Int. Cl.[4] ..... F04C 18/344; F04C 29/02

[52] U.S. Cl. ..... 418/76; 418/82; 418/93; 418/268

[58] Field of Search ..... 418/76, 82, 93, 268, 418/267

[56] References Cited

U.S. PATENT DOCUMENTS

| | | | |
|---|---|---|---|
| 979,262 | 12/1910 | Cota | 418/268 |
| 2,255,785 | 9/1941 | Kendrick | 418/82 |
| 2,357,334 | 9/1944 | Kendrick et al. | 418/82 |
| 2,455,297 | 11/1948 | Curtis et al. | 418/93 |
| 4,071,306 | 1/1978 | Calabretta | 418/93 |
| 4,403,929 | 9/1983 | Nagasaku et al. | 418/93 |

FOREIGN PATENT DOCUMENTS

| | | | |
|---|---|---|---|
| 2262814 | 6/1974 | Fed. Rep. of Germany | 418/82 |

*Primary Examiner*—John J. Vrablik

*Attorney, Agent, or Firm*—Bruce L. Adams; Van C. Wilks

[57] ABSTRACT

A rotary vane compressor has a cylinder having an oval-shaped compartment in which is rotatably mounted a rotor. Front and rear side blocks close the opposite ends of the cylinder. A plurality of vanes are slidably mounted in slots formed around the rotor and divide the cylinder compartment into expansible working chambers. A gas inlet opening is disposed at the upstream end of each working chamber for admitting a gas to be compressed and a gas outlet opening is disposed at the downstream end of each working chamber for discharging the compressed gas. A source of pressurized lubricant oil is fed to the base of the vane slots to bias the vanes outwardly so that the vane tips slidably engage the inner wall of the cylinder compartment during rotation of the rotor. To avoid undue wear and abrasion between the vane tips and the compartment inner wall, the pressurized lubricant oil is fed to the vane slots at a reduced pressure while the vanes travel from the gas inlet openings to the region of the gas outlet openings, and to avoid vane chattering after discharge of the compressed gas at the gas outlet openings, the pressurized lubricant oil is fed to the vane slots at a higher pressure while the vanes travel in the region of the gas outlet openings.

16 Claims, 4 Drawing Sheets

ROTARY VANE COMPRESSOR HAVING PRESSURE-BIASED VANES

BACKGROUND OF THE INVENTION

The present invention relates to a vane typed compressor which can be employed in a car air conditioner or small sized refrigerator and particularly to an improvement for elimination the chattering phenomenon which is caused by the contact of the vanes and cylinder wall near the gas outlet parts.

Generally, a vane typed compressor has an oblong or generally oval-shaped cylinder room or compartment formed by a cylinder 1 and front and rear side blocks 2 and 3 which may comprise side portions of said cylinder 1. A rotor 5 is rotatably mounted in said cylinder 1 and has a plurality of vanes 4 which are mounted to undergo radial sliding movement in slits or slots formed on the rotor. In the embodiment shown, the rotor 5 divides the cylinder compartment into two separate sub-compartments. A rear compressor portion 6 is formed at the rear side of said cylinder 1 and rotor 5, and a cavity portion 7 is disposed at the rear side rear block 3 of said compressor portion 6. A quantity of hydraulic fluid such as lubrication oil 8 is kept in said cavity portion 7 under a gas pressure which is created by the pressurized gas expelled from an outlet port of said cavity portion 7. A sealed casing 9 extends co-axial to the rotor axis of said rotor 5, and houses said rotor 5. The rotor 5 has a protruded shaft portion 5*a* which protrudes through front head 9*a* of said sealed casing 9 and is sealed by a mechanical seal 10 and is connected with a pulley 12 via an electro-magnetic clutch 11.

A low pressure working gas admitted through an inlet port 9*b* of the front head 9*a* flows into said cylinder room through an inlet port 1*a* of said cylinder 1 and is compressed and changed to high pressure gas in the working areas or working chambers in said cylinder 1 according to the radial sliding actuation of said vanes 4, and said high pressure gas is fed to said cavity portion 7 through an outlet port 1*b* and an oil separater 13, and further, said high pressure gas is fed from an outlet port 9*c* of said casing 9 to a pipe (not shown). As known in the art, the vanes 4 divide the cylinder compartment in expansible working chambers which progressively increase and then decrease in size during rotation of the rotor 5 to thereby compress the gas in a compression cycle.

In such a vane typed compressor, the pressurized lubrication oil 8 is fed to the bearing portions of said side blocks 2 and 3 and the mechanical seal portion 10 through said rear and front side blocks 2 and 3 and through communication parts or holes 14 and 15 formed in said cylinder 1. The lubrication oil which is fed from the sliding faces in said bearing portion is fed to slit or slot portions 4*a* which slidably support said vanes 4 via a ring shaped recess portion 5*b* and a set of communication parts or holes 20 and 21 under a decreased or reduced pressure condition and a contacting pressure of the vane tips against said cylinder inner wall is obtained by said oil pressure and the rotating power of said rotor 5 whereby said vanes are equally outwardly pushed by said oil pressure.

However, in the above noted construction, as shown in FIG. 3, after the working gas is expelled from said outlet port 1*b* by the rotor 5 rotation, oil mist and liquid gas are mixed into said working gas in a cavity region "a" so that a high pressure condition is created which tends to compress said liquid gas. Further, said vanes 4 are pushed inwardly into said rotor 5 against the pressure of said lubrication oil 8 and abruptly strike said inner wall face of said cylinder 4 producing a considerably chattering noise.

As one means for eliminating the above noted chattering phenomenon, it is possible to constantly bias the vanes 4 outwardly using a very high pressure oil, however, this approach is disadvantageous because the sliding surface of said cylinder inner face becomes quickly abraded by the vane tips thereby increasing the load of means used to rotationally drive the compressor.

Therefore, the present invention aims to control the interface pressure between said vanes and cylinder inner wall in a preferable pressure condition by applying high pressure oil to only the chattering portion of the vanes. The object of the present invention is to provide a compressor which effectively eliminates the above noted chattering phenomenon.

BRIEF DESCRIPTION OF THE DRAWINGS

In the present embodiment, the same numerals are used to denote the same portions as in the prior art, and different numerals are used to donate different portions.

FIG. 4 shows a compressor according to the present invention in which the high pressure communication parts or holes 14, 15 and 16 are connected to a source of hydraulic fluid such as lubrication oil 8, the holes being formed in a rear side block 3, cylinder 1 and front side block 2 in a manner well known in the art. A pair of communication ports or holes 20 and 21 are formed in the rear and front side blocks 2 and 3 to define a passage for the lubrication oil 8 which flows at reduced pressure from a gap portion between the bearing portions 2*a* and 3*a* of said side blocks 2 and 3 and the rotor shaft portion 5*a*. The communication holes 20 and 21 are connected to a set of grooves 22 and 23 formed between the bearing surface between said rotor shaft portion 5*a* and said side blocks 2 and 3.

Figure 5A:
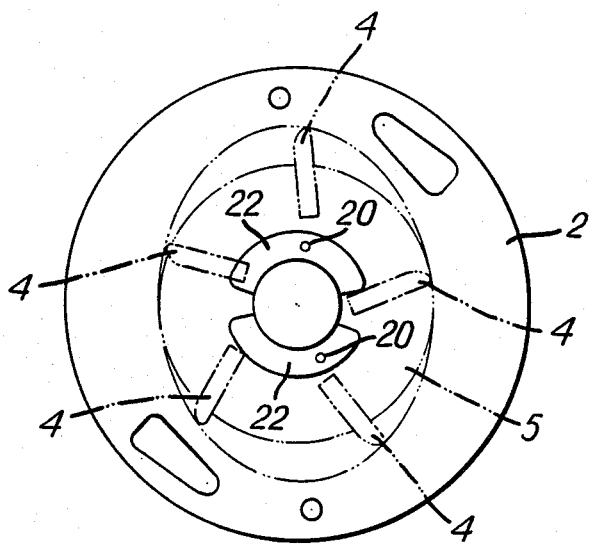
Figure 5B:
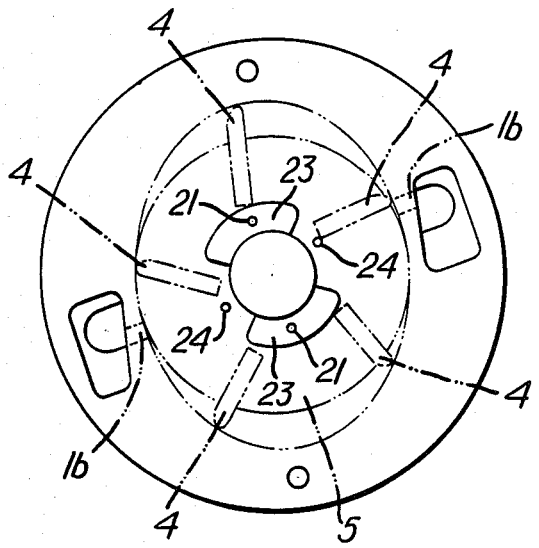

The grooves 22 and 23 each comprise a pair of arc- or fan-shaped openings symmetrically positioned at said bearing, portions 2*a* and 3*a* in diametrically opposed relation as shown in FIGS. 5*a* and *b*. By such a construction, when said vanes 4 are positioned on the short axis side of the oblong cylinder room, (namely, when said vanes 4 are retracted or positioned substantially fully in said rotor 5), the pressure of lubrication oil does not activate the vanes and a back pressure is applied to said vanes 4 according to the rotary speed of the rotor 5. The back pressure is set in zero condition at a 180° rotary position.

Figure 1:
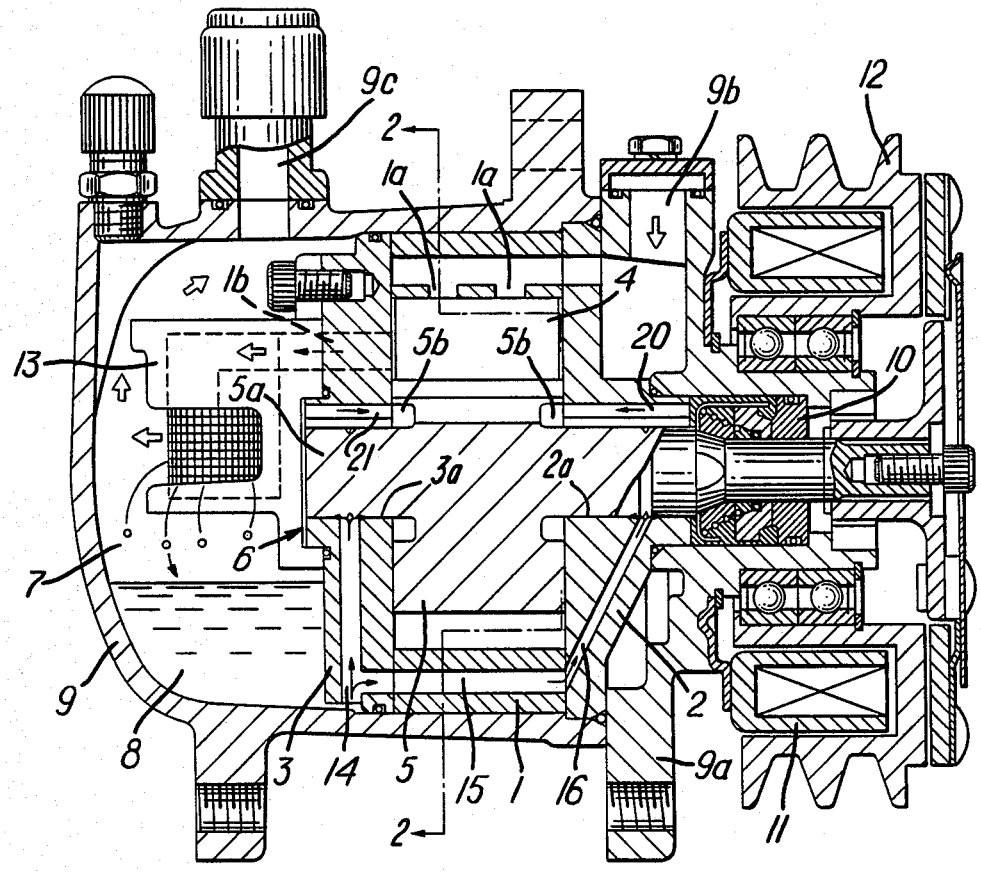
FIG. 1 PRIOR ART
FIG. 1 shows a side cross sectional view of a conventional compressor.
Figure 2:
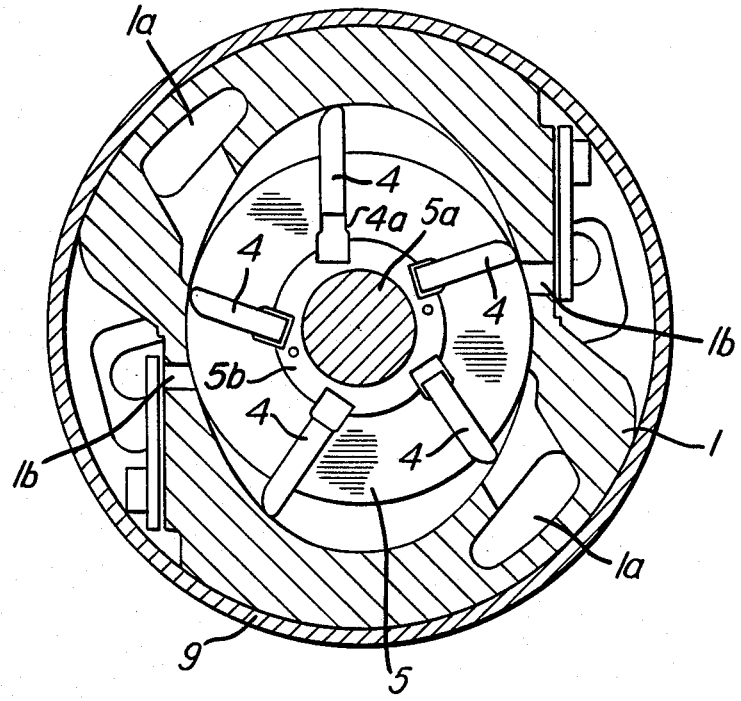
FIG. 2 PRIOR ART
FIG. 2 shows a cross sectional view along line 2—2 of FIG. 1.
Figure 3:
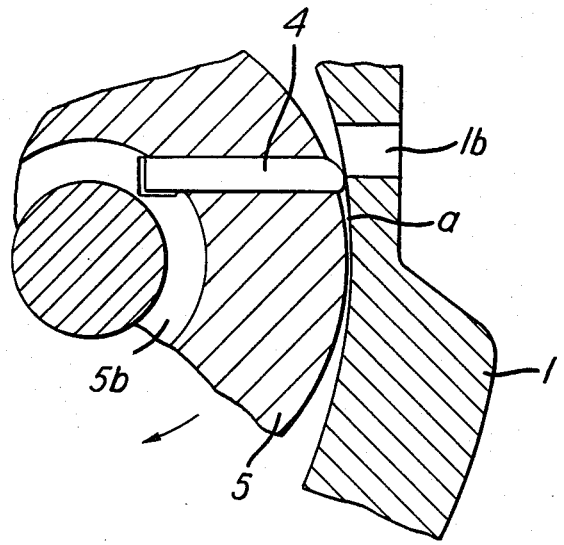
FIG. 3 PRIOR ART
FIG. 3 shows an enlarged cross sectional view of near the outlet port of FIG. 1.
Figure 4:
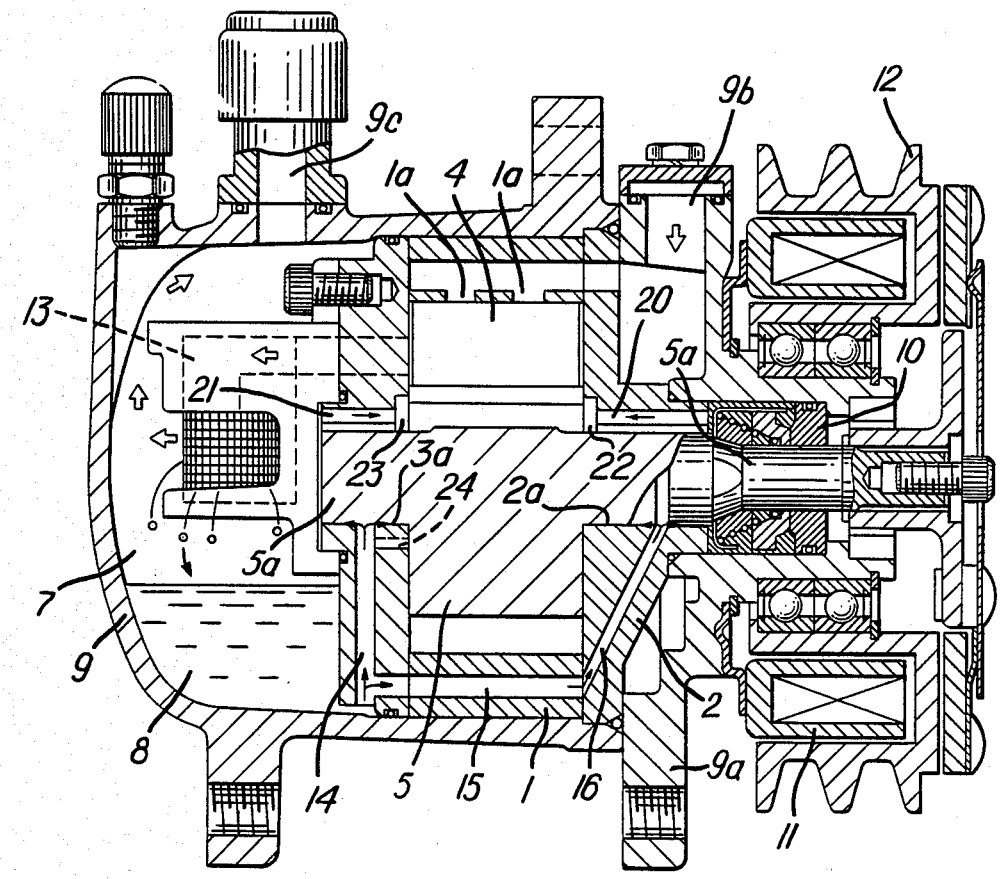
FIG. 4 shows a side cross sectional view of a compressor according to the present invention, and FIGS. 5(*a*) and (*b*) show flat plan views of front and rear side blocks.

Further, a pair of small holes 24 are connected to and open into said high pressure communication hole 14 in the neighbourhood of the outlet holes 1*b* of said rear side block 3, said small holes open into the vane slit base portions of said rotor 5. The position of each small hole 24 is located at a position which is angularly displaced in the rotary direction of the rotor from the position of an outlet hole 1*b* of said cylinder room. Therefore, as shown in FIG. 3, in the region or space "a" located immediately downstream from the region where the compressed gas was expelled from said outlet part 1b, a back pressure created by the high pressure lubrication oil fed from said small hole 24 to the inner ends of the vane slit is temporarily applied to the base of the vanes whereby said vanes 4 can smoothly rotate against the inward pressure applied to the vane tips by the cylinder inner wall which tends to force the vanes inwardly at said space "a".

According to the present invention, a back pressure dependent on the vane protrusion amount is applied to the vanes, namely, a high back pressure is applied to said vanes according to a temporary high pressure in the regions near said outlet ports whereby the vane chattering phenomenon near said outlet holes can be prevented and a smooth rotation of said rotor is obtained. Further, according to the present invention, the vane contacting pressure against the cylinder inner wall can be controlled at a preferable value, and furthermore, it is possible to keep a preferable contact friction between said vanes and cylinder inner wall, whereby the abrasion characteristic becomes improved and the load on the engine driving the compressor becomes smaller.

We claim:

1. A rotary vane compressor comprising: a cylinder having a compartment therein defined at least in part by an inner wall of the cylinder, and a pair of end portions connected to and closing the opposite ends of the cylinder; a rotor rotationally driven during use of the compressor and mounted to undergo rotation within the cylinder compartment, the rotor having a plurality of angularly spaced radially extending slots, and shaft portions protruding axially outwardly from opposite ends of the rotor and extending into openings formed in the cylinder end portions, the rotor and rotor shaft portions being rotatable relative to the cylinder end portions; a plurality of vanes slidably disposed within respective ones of the rotor slots so as to slidably extend therefrom and retract thereinto during rotation of the rotor, the vanes having base portions slidably received within the rotor slots and tip portions which make slidable contact with the cylinder inner wall during rotation of the rotor thereby dividing the cylinder compartment into plural expansible working chambers which alternately increase in size as the vanes slidably extend from the rotor slots to define a suction stroke and decrease in size as the vanes slidably retract into the rotor slots to define a compression stroke during rotation of the rotor; means defining a gas inlet opening at the upstream end of each working chamber for admitting therein a gas to be compressed during the suction stroke; means defining a gas outlet opening at the downstream end of each working chamber for discharging therefrom gas compressed in the working chamber during the compression stroke; and means for applying hydraulic pressure at a relatively lower pressure level to the vane base portions whenever the vanes are rotated into the regions of the gas inlet openings and continuously thereafter throughout the suction stroke and for a major part of the compression stroke to urge the vanes radially outwardly and thereby urge the vane tip portions into sliding contact with the cylinder inner wall during rotation of the rotor and for applying hydraulic pressure at a relatively higher pressure level to the vane base portions whenever the vanes are rotated into the regions of the gas outlet openings and continuously thereafter at least until the vanes are fully retracted in the rotor slots to thereby more forcefully urge the vane tip portions into sliding contact with the cylinder inner wall to effectively prevent chattering of the vanes in the vicinity of the gas outlet openings, the means for applying hydraulic pressure comprising a high pressure port in one of the cylinder end portions for receiving pressurized hydraulic fluid during use of the compressor, first passage means connected to the high pressure port for flowing the hydraulic fluid to the radially inner ends of the vane slots, the first passage means having means for reducing the pressure of the pressurized hydraulic fluid to the relatively lower pressure level, and second passage means connected to the high pressure port for flowing the hydraulic fluid to the radially inner ends of the vane slots at the relatively higher pressure level.

2. A rotary vane compressor according to claim 1; wherein the first passage means includes means defining grooves in at least one of the cylinder end portions, the grooves establishing fluid communication with the vane slots during different predetermined angular extents of rotation of the rotor to thereby apply hydraulic pressure at the relatively lower pressure to the vane base portions, and the second passage means includes means defining throughbores in at least one of the cylinder end portions, the throughbores having one end in fluid communication with the high pressure port and having another end positioned to establish fluid communication with the vane slots as the vanes move into the regions of the respective gas outlet openings during rotation of the rotor to thereby apply hydraulic pressure at the relatively higher pressure to the vane base portions.

3. A rotary vane compressor according to claim 1; wherein the first passage means includes means defining a set of grooves positioned to make fluid communication with successive ones of the radially inner ends of the vane slots as the vanes rotate into the regions of the gas inlet openings and continuously thereafter for a predetermined angular extent of rotation of the rotor, and means for flowing the hydraulic fluid to the set of grooves; and the second passage means comprises means defining at least one throughbore having one open end positioned to make fluid communication with successive ones of the radially inner ends of the vane slots as the vanes rotate into the regions of the gas outlet openings, and means for flowing the hydraulic fluid to the other open end of the throughbore.

4. A rotary vane compressor according to claim 3; wherein the means defining a set of grooves comprises means defining at least one pair of grooves disposed in angularly spaced relation with respect to the direction of rotation of the rotor.

5. A rotary vane compressor according to claim 4; wherein the grooves have an arc shape and extend a predetermined angular extent in the direction of rotation of the rotor.

6. A rotary vane compressor according to claim 3; wherein the rotor divides the cylinder compartment into a plurality of separate sub-compartments, and wherein one of the number of the vanes and the number of the sub-compartments is an odd number and the other is an even number.

7. A rotary vane compressor according to claim 6; wherein the number of the vanes is an odd number and the number of the sub-compartments is an even number.

8. A rotary vane compressor with pressure-biased vanes comprising: a cylinder having opposite ends and having an inlet hole for admitting gas and an outlet hole for discharging compressed gas; a rotor mounted for rotation in said cylinder and having a plurality of radially extending vane slots; a plurality of vanes slidably disposed in respective ones of said vane slots; front and rear side blocks closing the opposite ends of said cylinder, the rotor and the front and rear side blocks defining a plurality of cylinder sub-compartments, and one of the number of the vanes and the number of the sub-compartments being an odd number and the other being an even number; at least one of the front and rear side blocks having therein a groove and an independent hole each opening at a surface thereof which determines the axial end position of the rotor; a casing enclosing said cylinder and having a cavity which stores and supplies lubricant oil under high pressure; at least one first passage means for supplying the lubricant oil to said groove such that the lubricant oil is supplied into said groove and exerts a middle pressure which is lower than the high supply pressure to the bases of the vanes thereby pressing the heads of the vanes against the inner wall of the cylinder, the first passage means having a narrow portion effective to reduce the pressure of the lubricant oil from the high supply pressure to the middle pressure; and at least one second passage means for supplying the lubricant oil to said hole such that the lubricant oil is supplied into said hole and exerts a high pressure which is higher than the middle pressure to the bases of the vanes thereby more forcefully pressing the heads of the vanes against the inner wall of the cylinder at least while the heads of the vanes engage with said inner wall of the cylinder in the region of said outlet hole, the hole and the second passage means being dimensioned and positioned to apply the high pressure to the base of each vane while the head of the vane engages with the outlet hole and continuously thereafter till the head of the vane comes to its most fully retracted position in the rotor.

9. A rotary vane compressor as claimed in claim 8; wherein the sectional shape of the inner wall of the cylinder is approximately oval.

10. A rotary vane compressor as claimed in claim 8; wherein the number of the vanes is an odd number and the number of the sub-compartments is 2.

11. A rotary vane compressor as claimed in claim 10; wherein the number of the vanes is 5.

12. A rotary vane compressor as claimed in claim 8; wherein the narrow portion comprises a gap between at least one of the bearing portions of the side blocks and the rotor.

13. A rotary vane compressor as claimed in claim 8; wherein the hole into which the high pressure oil is supplied is formed in the rear side block.

14. A rotary vane compressor as claimed in claim 8; wherein the groove into which the middle pressure oil is supplied is formed in the front side block.

15. A rotary vane compressor as claimed in claim 8; wherein the groove into which the middle pressure oil is supplied comprise grooves formed in the front and rear side blocks.

16. A rotary vane compressor as claimed in claim 8; wherein the groove and passage means are dimensioned and positioned to apply the middle pressure to the base of each vane at least while the gas admitted through the inlet hole is under relatively low pressure.

* * * * *